US007354302B1

(12) United States Patent
Walker

(10) Patent No.: US 7,354,302 B1
(45) Date of Patent: Apr. 8, 2008

(54) CAR BATTERY TERMINAL QUICK CONNECT HANDLE

(76) Inventor: Ronald Walker, 16231 W. Maricopa St., Goodyear, AZ (US) 85338-2838

( * ) Notice: Subject to any disclaimer, the term of this patent is extended or adjusted under 35 U.S.C. 154(b) by 0 days.

(21) Appl. No.: 11/594,648

(22) Filed: Nov. 7, 2006

(51) Int. Cl.
*H01R 3/00* (2006.01)

(52) U.S. Cl. ..... 439/500; 439/759

(58) Field of Classification Search ..... 439/761, 439/764, 773, 801, 500, 759, 762, 765, 804, 439/887, 755

See application file for complete search history.

(56) References Cited

U.S. PATENT DOCUMENTS 3,739,322 A * 6/1973 Haegert ..... 439/764
4,256,361 A 3/1981 Bell
4,345,807 A 8/1982 Shekel et al.
4,576,430 A 3/1986 Dufresne
4,929,199 A 5/1990 McKinnon
4,959,031 A * 9/1990 Ruiz et al. ..... 439/759
5,254,020 A * 10/1993 Obligar ..... 439/761
5,595,510 A * 1/1997 Obligar ..... 439/761
6,805,593 B2 10/2004 Spaulding et al.

* cited by examiner

*Primary Examiner*—Edwin A. Leon

(57) ABSTRACT

A quick connect unit is used to quickly connect a battery cable to a terminal of a battery, such as an automobile battery. The quick connect unit includes jaws that are adapted to be connected to a battery terminal and a handle connected to the jaws that is squeezed to lock the jaws to the battery terminal in electrical contact with that terminal. The handle can be locked in a position that locks the jaws to the terminal. An electrical connector is mounted on the element and a battery cable is easily connected to and disconnected from the electrical connector.

2 Claims, 1 Drawing Sheet

CAR BATTERY TERMINAL QUICK CONNECT HANDLE

TECHNICAL FIELD OF THE INVENTION

Figure 1:
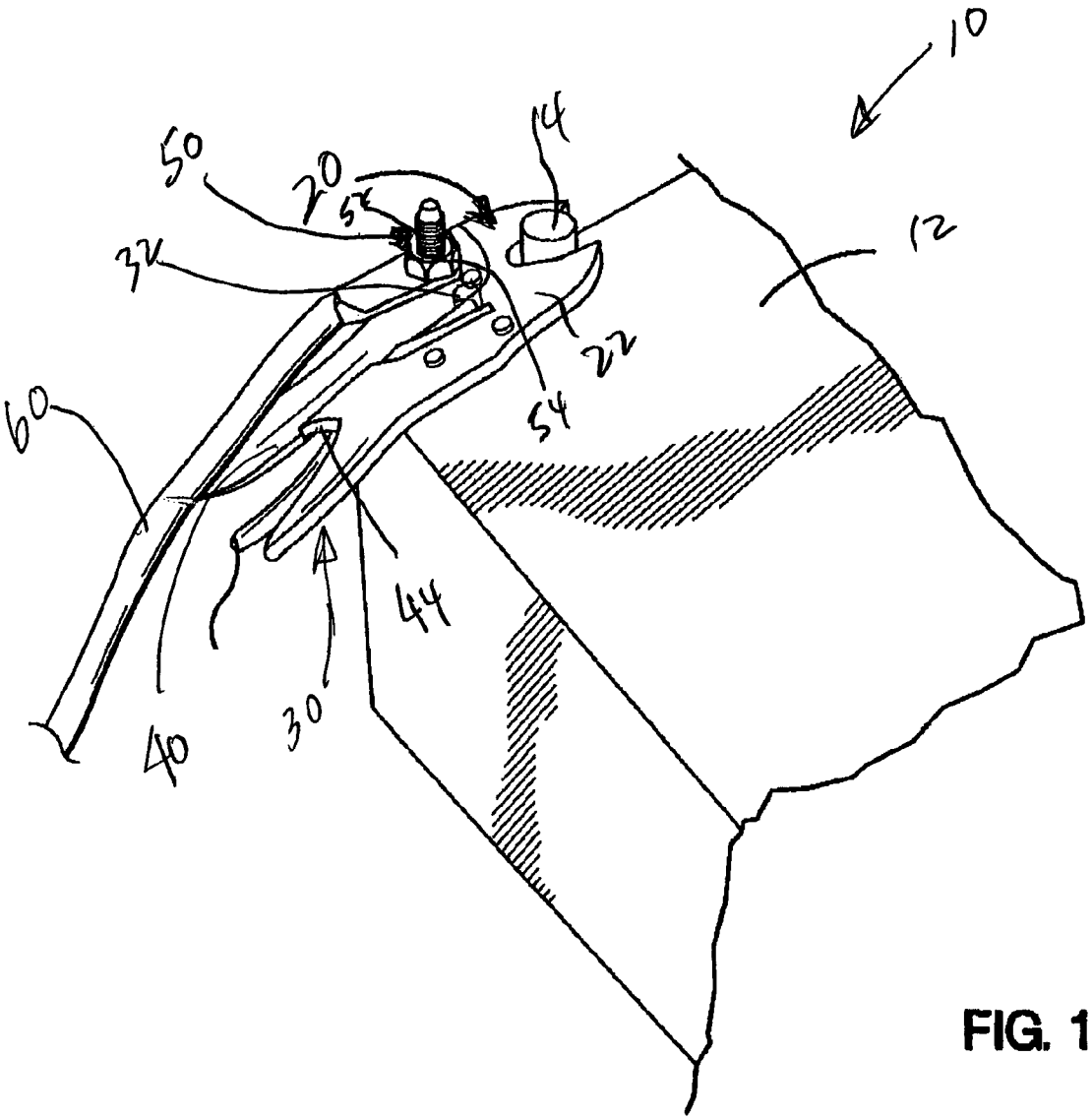

The present invention relates to the general art of electrical connectors, and to the particular field of electrical connectors for battery terminals.

BACKGROUND OF THE INVENTION

Most electrical storage batteries of the type used in association with generators or alternators driven by internal combustion engines for supplying electric current to starters, and other accessories of the engine, and to, for example, the various electrical components of an automotive vehicle are provided with upstanding tapered positive and negative terminal posts to which the required cables are clampingly attached. For many years, the clamping attachment of the cables has been accomplished by a split clamp formed of lead due to the inherent resistance of lead to acid induced deterioration. Briefly, this well known split clamp includes the lead body having a tapered hole formed therethrough to axially receive the battery terminal post, and the lead body is split radially of the tapered hole to provide a pair of spaced ears. A cross-bore is formed transversely through the spaced ears for receiving an adjusting bolt which in cooperation with a suitable nut applies a squeezing pressure on the ears to reduce the internal diameter of the tapered hole for clamping engagement with the battery terminal post. The cable is attached to the lead body so that conductive contact between the conductors of the cable and the terminal post of the battery is made through the lead body of the split clamp.

The above described split lead clamp has been one of the most troublesome devices on an automotive vehicle both from mechanical and electrical standpoints. Since lead is a relatively soft metal, it is easily stretched or otherwise deformed and is easily fatigued, and as a result, these prior art clamps cannot tolerate much in the way of abuse which normally occurs when installing, removing and reinstalling the clamps.

When these split battery clamps become stretched, to the extent where the ears are touching each other, the clamp looses its clamping ability and loose connections result. Oftentimes the ears of the clamp will become deformed making it very difficult to tighten or loosen the adjusting bolt which can result in several problems. When the bolt cannot be properly tightened, loose connections result, and when the bolt cannot be loosened it can become extremely difficult to remove the clamp and batteries have been ruined by loosening or breaking of the terminal post resulting from attempts to remove a tight clamp. Deformed ears have all too often resulted in rounding of the nut and the head of the bolt and stripping of the threads. Since the adjusting bolt and its associated nut cannot be made of lead, and must be formed of a harder metal, they are subject to acid induced deterioration and become heavily corroded which weakens them and also results in loosening and tightening problems.

In addition to the above mentioned and other mechanical problems of the prior art split battery clamps, they are also subject to electrical problems. A loose connection, of course, results in an increase in the resistance of the electric circuit and a consequent loss of power to the starter and other accessories. Even a clamp which appears to be tight can produce problems in that a corrosion build-up can occur between the terminal post and the internal surface of the clamp, and such corrosion will increase the resistance to current flow and in severe cases has been known to result in complete interruption of current flow in the circuit.

Therefore, a need exists for new and improved connectors for attaching battery cables to the terminal posts of electric storage batteries, with those connectors overcoming some of the problems and drawbacks of the prior art.

Furthermore, battery terminals are generally a continuing source of potential problems in automotive and related applications. Acidic fumes given off by the battery result in corrosion building up on the battery, and particularly on the battery terminals. The positive terminal of batteries is generally the location at which the most corrosion builds up. Corrosion, to a lesser extent, builds on the negative battery terminal, also.

When corrosion builds up on a battery terminal to the extent that it interferes with the electrical contact between the battery terminal and the clamp or connector which electrically connects an electrical cable to a battery, deterioration in the electrical system of the vehicle occurs. Ultimately, the deterioration results in a failure of the vehicle's electrical system. This is generally caused by an increase in resistance between the battery terminal and the attached cable and, ultimately, a cessation or breaking of electrical contact due to the corrosion.

SUMMARY OF THE INVENTION

The above-discussed disadvantages of the prior art are overcome by a quick connect unit that is used to quickly connect a battery cable to a terminal of a battery, such as an automobile battery. The quick connect unit includes jaws that are adapted to be connected to a battery terminal and a handle connected to the jaws that is squeezed to lock the jaws to the battery terminal in electrical contact with that terminal. The handle can be locked in a position that locks the jaws to the terminal. An electrical connector is mounted on the element and a battery cable is easily connected to and disconnected from the electrical connector.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURE

The invention can be better understood with reference to the following drawing and description. The components in the FIGURES are not necessarily to scale, emphasis instead being placed upon illustrating the principles of the invention. Moreover, in the FIGURE, like referenced numerals designate corresponding parts throughout the different views.

FIG. 1 is a perspective view of a quick connect element embodying the present invention.

DETAILED DESCRIPTION OF THE INVENTION

Referring to the FIGURE, it can be understood that the present invention is embodied in an electrical connecting element unit 10. Unit 10 comprises a battery 12 having an electrical terminal 14. In one form of the invention, the battery is a motor vehicle battery, such as an automobile battery. A clamp element 20 has a jaw section 22 that is movable between a closed condition and an open condition with the jaw section being shown in the closed condition. The jaw section is in electrical contact with the terminal when the jaw section is in the closed condition.

A handle section 30 is electrically connected to the jaw section and can be unitary and one-piece with the jaw section. The handle section is movable between an open condition and a closed condition with the jaw section being in the closed condition when the handle section is in the closed condition. The handle section is shown in the closed condition in the figure. A biasing mechanism 32 such as a spring or the like can be included to bias the handle section toward the open condition. A lock 40 is located on the handle section and holds the handle section in the closed condition when the lock is activated. The lock includes a release mechanism 44.

An electrical connector 50 is electrically mounted on the handle section. The electrical connector is in electrical contact with the terminal of the battery when the handle section is in the closed condition and the jaw section is in the closed condition on the terminal. Electrical connector 50 includes a bolt 52 mounted on the handle section and a nut 54 threadably mounted on the bolt so an electrical cable (not shown) can be easily attached to the electrical connector.

An electrical cord 60 is electrically connected to the handle section via electrical connector 50. Electrical cord 60 is in electrical contact with the electrical connector and the terminal of the battery when the jaw section is in the closed condition on the terminal.

Use of unit 10 can be understood from the teaching of the foregoing disclosure and thus will be only briefly discussed. Handle section 30 is manipulated to open the jaw section. The jaw section is then located adjacent to the terminal of a battery. The handle section is then manipulated to close the jaw section onto the terminal so that electrical contact is made between the jaw section and the terminal. An electrical cord is connected to the handle section using connector 50 so that cord is electrically connected to the terminal. Cord 60 can be a cord used in a motor vehicle to connect the electrical system of that motor vehicle to the battery. The lock can be set to ensure that the jaws stay connected to the terminal.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. An electrical connecting unit comprising:

A) a battery having an electrical terminal; and

B) a clamp element having (1) a jaw section that is movable between a closed condition and an open condition, the jaw section being in electrical contact with the terminal when the jaw section is in the closed condition, (2) a pair of scissor handles electrically connected to the jaw section, the pair of scissor handles section being movable between an open condition and a closed condition with the jaw section being in the closed condition when the pair of scissor handles section is in the closed condition, (3) a lock on the pair of scissor handles section which holds the pair of scissor handles section in the closed condition when the lock is activated, the lock including a release mechanism, (4) an electrical connector electrically mounted on the pair of scissor handles section, the electrical connector being in electrical contact with the terminal of the battery when the pair of scissor handles section is in the closed condition and the jaw section is in the closed condition on the terminal, and (5) an electrical cord electrically connected to the electrical connector on the pair of scissor handles section, the electrical cord being in electrical contact with the electrical connector and the terminal of the battery when the jaw section is in the closed condition on the terminal.

2. An electrical connecting unit consisting of:

A) a battery having an electrical terminal; and

B) a clamp element having (1) a jaw section that is movable between a closed condition and an open condition, the jaw section being in electrical contact with the terminal when the jaw section is in the closed condition, (2) a handle section electrically connected to the jaw section, the handle section being movable between an open condition and a closed condition with the jaw section being in the closed condition when the handle section is in the closed condition, (3) a lock on the handle section which holds the handle section in the closed condition when the lock is activated, the lock including a release mechanism, (4) an electrical connector electrically mounted on the handle section, the electrical connector being in electrical contact with the terminal of the battery when the handle section is in the closed condition and the jaw section is in the closed condition on the terminal, and (5) an electrical cord electrically connected to the electrical connector on the handle section, the electrical cord being in electrical contact with the electrical connector and the terminal of the battery when the jaw section is in the closed condition on the terminal.

* * * * *